US011713539B2

(12) United States Patent
Brisjö et al.

(10) Patent No.: US 11,713,539 B2
(45) Date of Patent: Aug. 1, 2023

(54) TUMBLE DRYER

(71) Applicant: Electrolux Professional AB (publ), Stockholm (SE)

(72) Inventors: Johan Brisjö, Stockholm (SE); Martin Nilsson, Stockholm (SE); Gunnar Ingemar Persson, Stockholm (SE)

(73) Assignee: Electrolux Professional AB (publ), Stockholm (SE)

( * ) Notice: Subject to any disclaimer, the term of this patent is extended or adjusted under 35 U.S.C. 154(b) by 138 days.

(21) Appl. No.: 16/636,203

(22) PCT Filed: Aug. 9, 2017

(86) PCT No.: PCT/EP2017/070161
§ 371 (c)(1),
(2) Date: Feb. 3, 2020

(87) PCT Pub. No.: WO2019/029799
PCT Pub. Date: Feb. 14, 2019

(65) Prior Publication Data

US 2021/0164154 A1 Jun. 3, 2021

(51) Int. Cl.
*D06F 58/20* (2006.01)
*D06F 58/02* (2006.01)

(52) U.S. Cl.
CPC ..... *D06F 58/206* (2013.01); *D06F 58/02* (2013.01)

(58) Field of Classification Search
CPC ..... D06F 58/206; D06F 58/02
See application file for complete search history.

(56) References Cited

U.S. PATENT DOCUMENTS 2,690,654 A * 10/1954 Graham ..... F24F 1/022 62/298
4,621,438 A * 11/1986 Lanciaux ..... D06F 58/06 34/604
5,343,632 A 9/1994 Dinh
7,377,052 B2 5/2008 Maruca
10,968,560 B2 4/2021 Park
2004/0079121 A1 4/2004 Yabuuchi
(Continued)

FOREIGN PATENT DOCUMENTS

CN 203744637 U * 7/2014
DE 1212700 A1 10/1993
(Continued)

OTHER PUBLICATIONS

International Search Report and Written Opinion issued in PCT/EP2017/070161 dated Oct. 17, 2017, 9 pages.
(Continued)

*Primary Examiner* — Edelmira Bosques
*Assistant Examiner* — Bao D Nguyen
(74) *Attorney, Agent, or Firm* — Pearne & Gordon LLP

(57) ABSTRACT

The present disclosure relates to a tumble dryer (1) with a rotatable drum (11) and a heat pump for drying process air that enters the drum, the heat pump comprising a condenser (19), a compressor (17), and an evaporator (15). In order to improve energy efficiency, the compressor (17) is located in the flow (21) of process air, between the evaporator (15) and the condenser (19). Thereby, heat dissipated from the compressor is used to pre-heat the process air flow before entering the condenser (19).

12 Claims, 3 Drawing Sheets

(56) References Cited

U.S. PATENT DOCUMENTS

| | | | | |
|---|---|---|---|---|
| 2005/0198852 | A1* | 9/2005 | Ono | D06F 58/20 34/604 |
| 2011/0277334 | A1 | 11/2011 | Lee | |
| 2016/0083893 | A1 | 3/2016 | Del Pos | |
| 2017/0191211 | A1 | 7/2017 | Kim | |
| 2018/0251933 | A1 | 9/2018 | Park | |
| 2020/0332457 | A1 | 10/2020 | Civanelli | |
| 2020/0370234 | A1 | 11/2020 | Brisjo | |
| 2021/0010195 | A1 | 1/2021 | Brisjo | |
| 2021/0156072 | A1 | 5/2021 | Won | |
| 2021/0164154 | A1 | 6/2021 | Brisjo | |

FOREIGN PATENT DOCUMENTS

| | | | | |
|---|---|---|---|---|
| DE | 102009046786 | A1 * | 6/2010 | D06F 58/20 |
| EP | 1411163 | A2 | 4/2004 | |
| EP | 2799612 | A1 | 11/2014 | |
| EP | 2896740 | A1 | 7/2015 | |
| EP | 2987904 | A1 | 2/2016 | |
| EP | 3118365 | A1 | 1/2017 | |
| EP | 3252218 | | 12/2017 | |
| EP | 3392393 | | 10/2018 | |
| JP | 2005253589 | | 9/2005 | |
| JP | 2006004254 | | 1/2006 | |
| JP | 2006230887 | A | 9/2006 | |
| JP | 2008237390 | | 10/2008 | |
| JP | 2011167425 | | 9/2011 | |
| JP | 2017099611 | | 6/2017 | |
| JP | 2017108834 | | 6/2017 | |
| WO | 2011155387 | | 12/2011 | |
| WO | 2017119585 | | 7/2017 | |
| WO | 2019029800 | | 2/2019 | |

OTHER PUBLICATIONS

U.S. Office action for U.S. Appl. No. 16/636,201 dated Jun. 25, 2021, 13 pages.

English translation of Office action counterpart application JP 2020-529808 dated Aug. 24, 2021, 7 pages.

English translation of Office action counterpart application JP 2020-529808 dated Feb. 22, 2022, 6 pages.

* cited by examiner

Fig 6
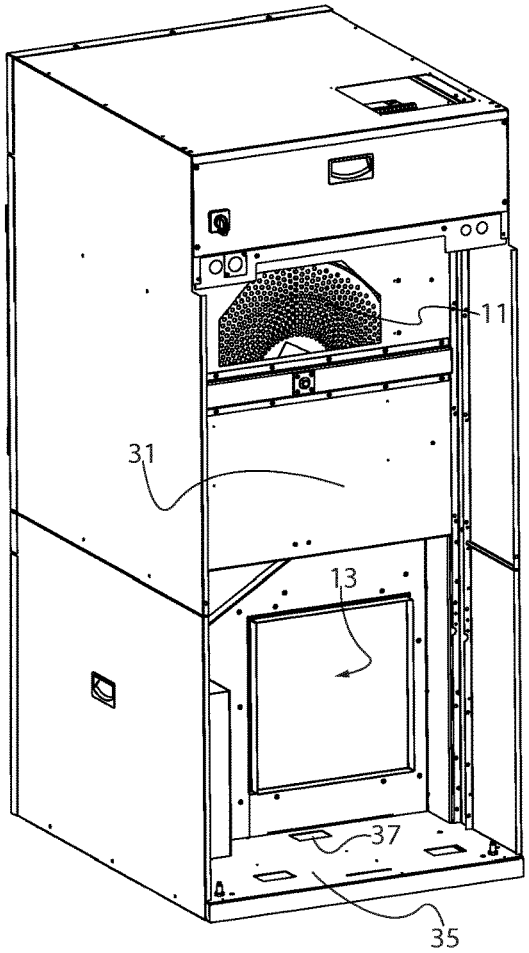
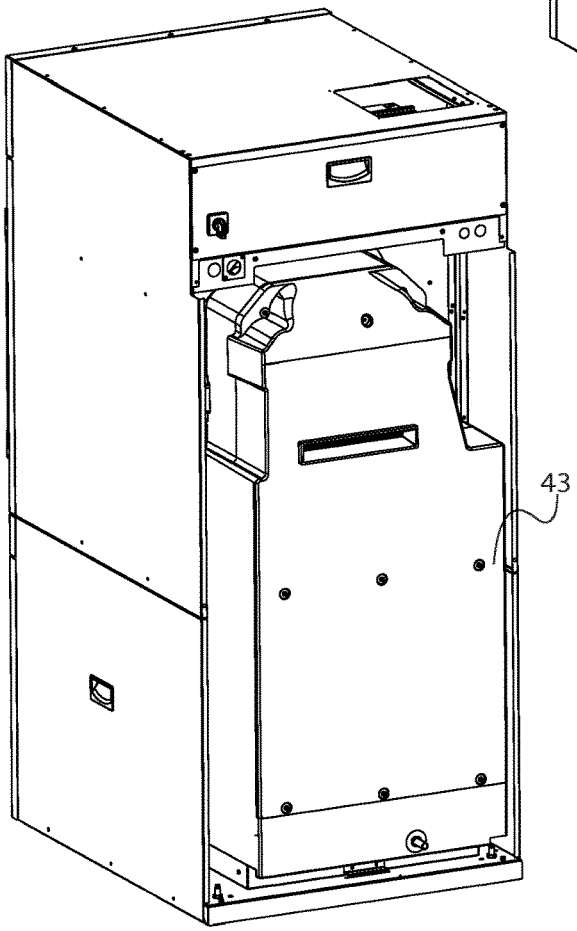
Fig 7
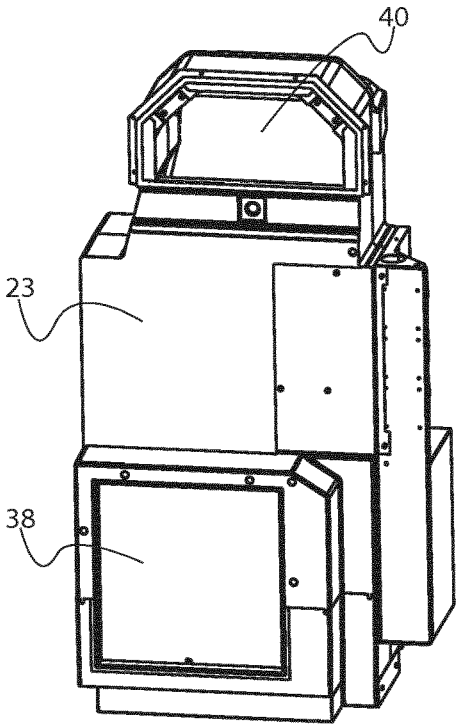
Fig 8

TUMBLE DRYER

FIELD OF THE INVENTION

The present disclosure relates to a tumble dryer comprising a housing, a rotatable drum in the housing being accessible from a front side of the housing, a fan arrangement for producing a flow of process air passing through the drum, and a heat pump for drying the process air before entering the drum, wherein the heat pump comprises a condenser, a compressor, and an evaporator.

TECHNICAL BACKGROUND

Such a tumble dryer is shown for instance in EP-3118365-A1, describing a tumble dryer with a heat pump. Although such tumble dryers are usually more energy efficient than tumble dryers with simple electric heating elements that recirculate less of the heat energy of process air leaving the drum, one problem with such tumble dryers is how to improve their energy efficiency further.

SUMMARY OF THE INVENTION

One object of the present disclosure is therefore to provide a tumble dryer with improved energy efficiency. This object is achieved by means of a tumble dryer as defined in claim 1. More specifically, in a tumble dryer of the initially mentioned kind, the compressor is located in the flow of process air, between the evaporator and the condenser. This means that heat dissipated by the compressor and the motor driving the compressor will contribute with heating the relatively cold process air leaving the evaporator. This improves the energy efficiency of the tumble dryer even further, and at the same time accomplishes efficient forced cooling of the compressor and the associated motor.

The condenser may be located behind the tumble dryer drum as seen from the housing front side, and above the compressor. This makes good use of the available space in the tumble dryer housing.

The condenser may be carried by a support arrangement forming a common frame which takes up the load of the condenser on either or both sides of the compressor as seen from the housing front side. This means that the load of the condenser need not be taken up by the tumble dryer housing behind the drum, which facilitates providing the heat pump as a separate, replaceable unit. The support arrangement may comprise a top frame carried by a plurality of legs, and the compressor may be located in between the legs. The condenser may be supported by a top frame supporting the condenser at the edges of the condenser bottom surface, such that process air may pass through said bottom surface at inner parts thereof.

The evaporator may be located in front of the compressor as seen from the housing front side, such that it can reach into the space under the tumble dryer drum which may not be completely occupied by fan arrangements and the like.

The evaporator, the compressor and the condenser may be arranged as components making up a heat pump unit, which may be removed from the tumble dryer without separating the components from each other. The heat pump unit may form a complete closed refrigerant loop and further include an expansion valve.

The components of the heat pump unit may be enclosed in an insulating shell, for instance made of expanded polypropylene, EPP. The shell may comprise an air inlet and an air outlet, as well as a drain tube for leading water out of the shell.

BRIEF DESCRIPTION OF THE DRAWINGS

FIG. 6-7 show the rear side of a tumble dryer before and after installing a heat pump unit.

FIG. 8 shows a perspective view of a heat pump shell as seen from the front thereof.

DETAILED DESCRIPTION

Figure 1:
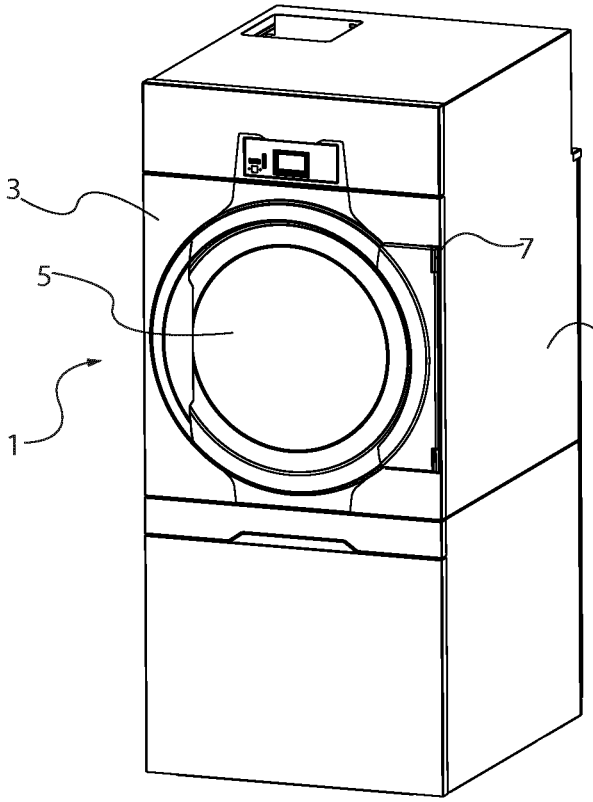
FIG. 1 shows a perspective view of a tumble dryer.

The present disclosure relates generally to a tumble dryer which is provided with a heat pump in order to achieve energy-efficient drying of laundry. An example of a tumble dryer 1 is illustrated in FIG. 1. The tumble dryer 1 has a front side 3 which is provided with a door 5 or hatch, attached to the front side 3 with hinges 7, which provides access to a tumble dryer drum behind the door 5 where wet laundry can be loaded.

Figure 2:
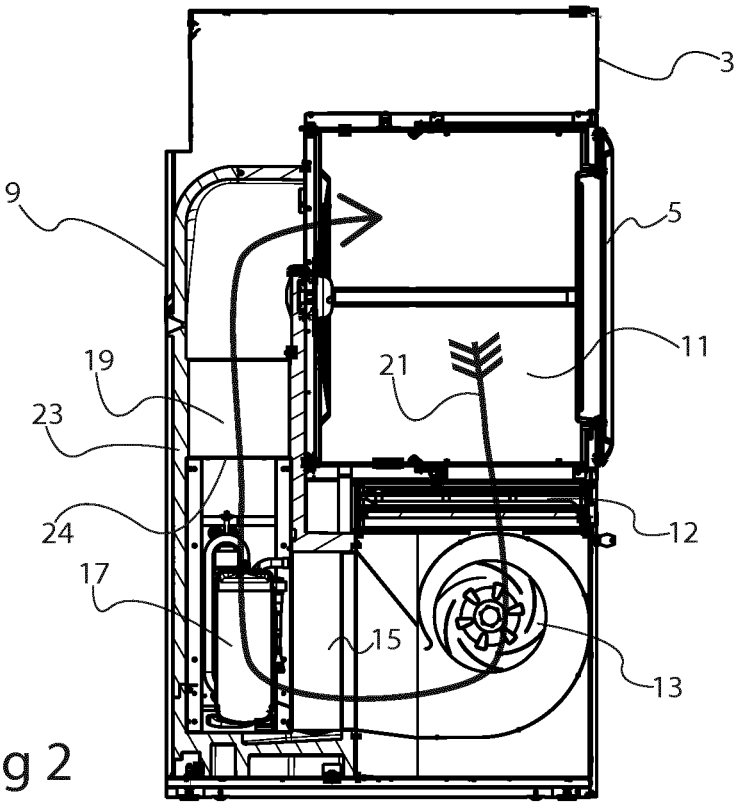
FIG. 2 illustrates schematically the flow of process air through a heat pump tumble dryer according to the present disclosure.

In a heat pump tumble dryer, process air drying the laundry can circulate within the outer enclosure of the tumble dryer. FIG. 2 illustrates schematically and in a cross section, components of such a tumble dryer as well as a process air path 21. As mentioned, the tumble dryer comprises a drum 11 in which wet laundry is placed. While the drum 11 rotates, a flow 21 of relatively dry process air is fed therethrough. The flow is provided by a fan 13 or blower, which in the illustrated case is located in a space under the drum 11.

Figure 3:
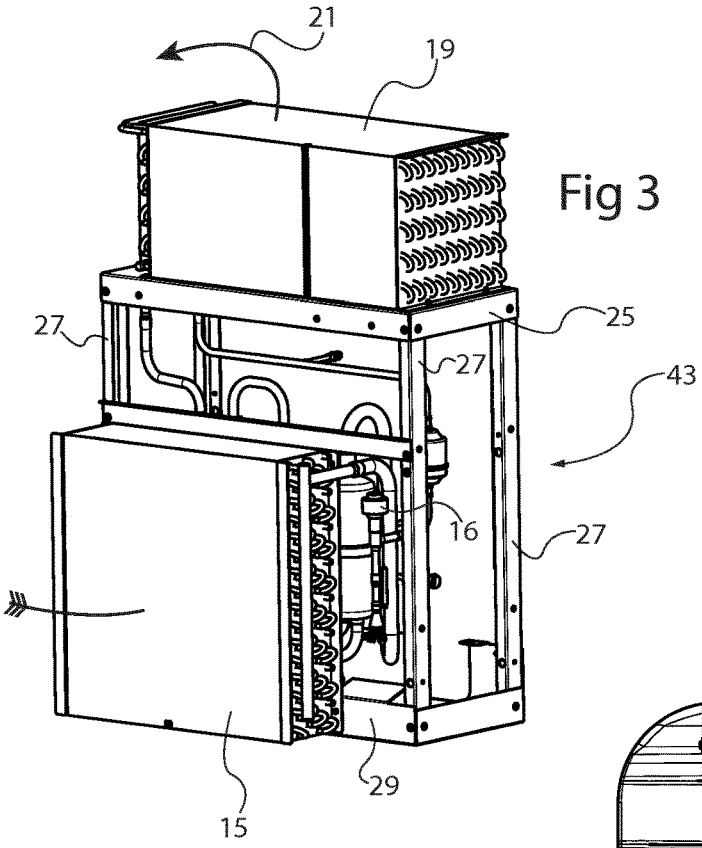
FIG. 3 shows a perspective view of a heat pump unit.

The tumble dryer includes a heat pump arrangement with an evaporator 15, a compressor 17, a condenser 19, and an expansion valve 16 (cf. FIG. 3). A refrigerant medium is forced through the heat pump arrangement by the compressor 17, and gathers energy in the evaporator 15 which is released in the condenser 19, as is well known per se.

As illustrated in FIG. 2, an air flow 21 is achieved where hot, humid air is extracted from the perforated drum 11 by means of the fan 13. The air flow passes a filter 12 before reaching the fan 13 and arrives at the evaporator 15, which cools the air flow such that moisture therein condenses into liquid water. This water is collected in the bottom section of the tumble dryer and is drained therefrom through a tube 39 (cf. FIG. 5).

The process air flow 21, which is now cooler and contains less water, is passed to the rear section of the tumble dryer and subsequently passes the condenser 19, which heats the air again. Then the heated, dry air is reintroduced into the drum 11 where it is again capable of absorbing water from the laundry therein.

In the tumble dryer of the present disclosure, the compressor 17 is located in the flow of process air 21, between the evaporator 15 and the condenser 19. This means that heat dissipated from the compressor, which heat would otherwise become more or less wasted, is used to pre-heat the flow of process air 21 before it reaches the condenser 19. At the same time, the compressor 17 becomes cooled by the process air flow 21, which to a great extent renders other cooling arrangements, used to avoid overheating of the compressor 17, unnecessary. This allows for a more energy efficient tumble dryer 1, that can be produced at a lower cost.

Figure 4:
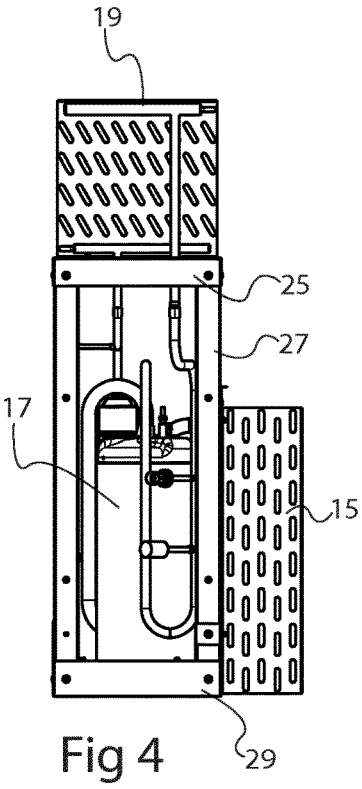
FIG. 4 shows a side view of the heat pump unit.

As shown in FIG. 2 and in greater detail in the side view of FIG. 4, such a configuration can be obtained by locating the condenser 19 behind the drum 11 as seen from the front side 3 of the tumble dryer, and above the compressor 17. As shown in the perspective view of a heat pump unit in FIG. 3, the evaporator 15 can extend horizontally from the compressor 17, and can as shown in FIG. 2 be located in front of the compressor 17 as seen from the housing front side 3. The evaporator 15 may then partly reach into the space below the rotatable drum 11, and may connect to the fan arrangement 13 to receive a flow of process air therefrom. There may be provided a framework 25, 27, 29 to which the compressor 17, the evaporator 15 and the condenser 19 are attached, such that there is formed a heat pump unit 43 which may be mounted as a whole in a tumble dryer. The heat pump unit may thus comprise a complete closed refrigerant loop, and may also include an expansion valve 16, as shown in FIG. 3.

The condenser 19 is carried by a support arrangement 25, 27 of this framework. The support arrangement may comprise a top frame 25 on which the condenser 19 rests. This top frame 25 may be rectangular to carry the condenser 19 at the outer edges of the condenser bottom surface, but may provide a large opening at the inner parts of this bottom surface to allow process air to flow through the condenser to be heated. The top frame 25 may be supported by a plurality of legs 27, in the illustrated case four legs 27, each located at a corner of the top frame 25. The compressor 17 may be located in between the legs 27, and the legs may be attached to a bottom frame 29. The condenser 19 is supported by the top frame 25 at the edges of the condenser bottom surface, such that process air may pass through this bottom surface 24 at inner parts thereof, as shown in FIG. 2.

The framework may be produced as sheet metal parts, such as aluminum or steel. Other framework configurations are possible. In order to allow the heat pump to be provided as a unit that can be installed or removed as a whole, it is preferred to provide a framework which takes up the load of the condenser 19 on either or both sides of the compressor 17 as seen from the housing front side 3, rather than for instance letting the condenser be suspended from an inner wall in the tumble dryer.

It is advantageous to keep the heat pump as a unit where the evaporator 15, the compressor 17 and the condenser 19 are included as components together with an expansion valve, and where the unit may be removed from or mounted in the tumble dryer without separating the components from each other, and instead handling them as a whole unit. The closed refrigerant medium loop in the heat pump is preferably filled and sealed in a central location, before being assembled in the tumble dryer. This also makes it simpler to replace a heat pump in an existing tumble dryer in the field. It is even possible to replace e.g. a gas heating unit in an existing tumble dryer with a heat pump.

Figure 5:
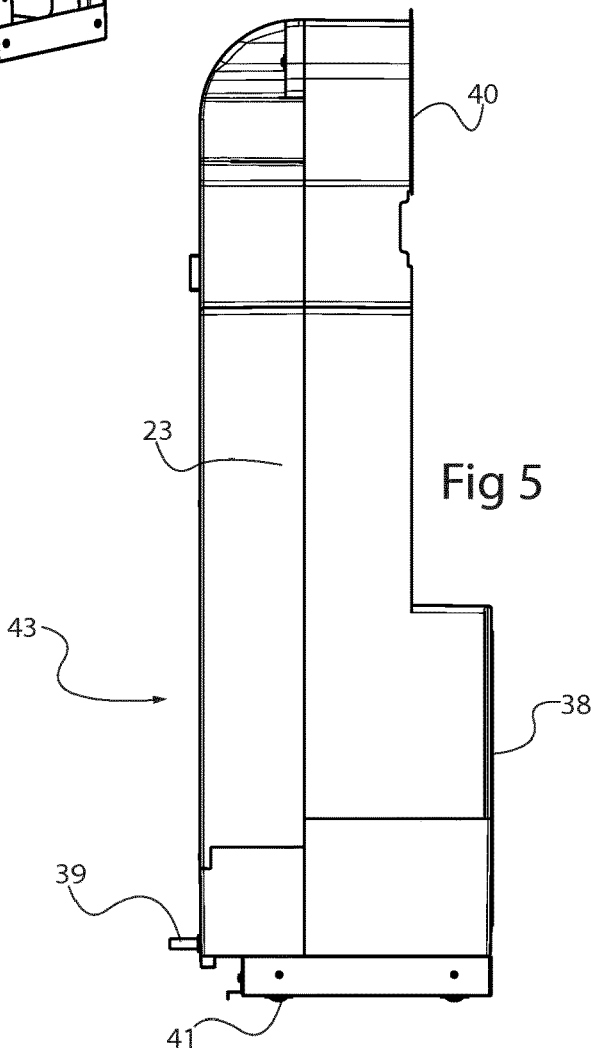
FIG. 5 shows a side view of a shell for the heat pump unit.

The provision of the heat pump as a complete unit also makes it possible to enclose the heat pump as a whole in an insulating shell 23 as shown in FIG. 5 as well as in the cross section of FIG. 2. Such a shell 23 includes openings 38, 40, one air inlet 38 in the bottom part providing access to the evaporator and facing the fan arrangement, and one air outlet 40 located over the condenser and being connected to the rotating drum. The shell may be assembled from multiple parts and may be made in a suitable insulating material such as expanded polypropylene, EPP. The insulating shell improves the energy efficiency of the tumble dryer even further.

The heat pump unit together with the insulating shell 23 may be provided with wheels 41 that facilitate moving the heat pump unit on a floor, for instance when replacing a heat pump unit in the field.

FIG. 6-7 show the rear side of a tumble dryer before and after installing a heat pump unit. As illustrated in FIG. 6, the rear side of the tumble dryer may reveal an opening 31 or recess by taking away a back wall (not shown). The opening space is sufficient space to enclose the heat pump unit, and once fitted therein, the back wall may again be attached to the tumble dryer.

As shown in FIG. 6, there is provided openings to the rotatable drum 11 and to the fan arrangement 13 that fit with the openings 38, 40 in the heat pump shell 23. There may further be provided slots 37 in the floor 35 of the rear opening 31 into which slots any wheels of the heat pump unit can project once the heat pump unit is in place, such that the heat pump unit rests firmly on the rear opening floor 35.

FIG. 7 shows the same perspective view as FIG. 6 when the heat pump unit is mounted into the rear opening. This can be done simply by rolling the heat pump unit in place in the rear opening 31, attaching some connection points of the heat pump to the tumble dryer e.g. by means of screws, and connecting the heat pump to the electric system of the tumble dryer.

FIG. 8 shows a perspective view of a heat pump shell 23 as seen from the front thereof, i.e. the side which connects to the tumble dryer drum 11. The drawing shows the openings 38, 40 in the bottom and upper parts connecting to the fan arrangement and to the drum, respectively. In addition to those openings, the shell may comprise electric wiring leading in and out of the shell as well as the aforementioned drain tube leading water out of the shell.

The present disclosure is not restricted to the above-described embodiment, and may be varied and altered in different ways within the scope of the appended claims.

The invention claimed is:

1. Tumble dryer comprising a housing, a rotatable drum in the housing being accessible from a front side of the housing, a fan arrangement for producing a flow of process air passing through the drum, and a heat pump for drying the process air before entering the drum, the heat pump comprising a condenser, a compressor, and an evaporator, wherein the compressor is located in the flow of process air, between the evaporator and the condenser, the condenser being carried by a support arrangement comprising a top frame, a bottom frame, and a plurality of legs extending therebetween, wherein the condenser is located above the top frame, wherein the compressor is located within the support arrangement between the plurality of legs and entirely below the top frame, the top frame supporting the condenser such that process air may pass through the top frame and through a bottom surface of the condenser at inner parts thereof.

2. Tumble dryer according to claim 1, wherein the condenser is located behind the drum as seen from the front side of the housing, and above the compressor.

3. Tumble dryer according to claim 1, wherein the support arrangement takes up a load of the condenser on either or both sides of the compressor as seen from the housing unit front side.

4. Tumble dryer according to claim 1, wherein the top frame supports the condenser at edges of a bottom surface of the condenser.

5. Tumble dryer according to claim 1, wherein the evaporator is located in front of the compressor as seen from the housing front side.

6. Tumble dryer according to claim 1, wherein the evaporator, the compressor and the condenser are arranged as components making up a heat pump unit, which is removable from the tumble dryer without separating said components from each other.

7. Tumble dryer according to claim 6, wherein the components of the heat pump unit are enclosed in an insulating shell.

8. Tumble dryer according to claim 7, wherein the shell comprises an air inlet and an air outlet.

9. Tumble dryer according to claim 7, wherein the shell comprises a drain tube for leading water out of the shell.

10. Tumble dryer according to claim 7, wherein the shell comprises expanded polypropylene, EPP.

11. Tumble dryer according to claim 6, wherein the heat pump unit comprises a complete closed refrigerant loop.

12. Tumble dryer according to claim 11, wherein the closed refrigerant loop includes the condenser, the compressor, the evaporator, and an expansion valve.

* * * * *